US007694383B2

(12) United States Patent
Zahuranec et al.

(10) Patent No.: US 7,694,383 B2
(45) Date of Patent: Apr. 13, 2010

(54) UPRIGHT VACUUM CLEANER WITH REMOVABLE POWER HEAD

(75) Inventors: Terry L. Zahuranec, North Olmsted, OH (US); David Scott Smith, Avon Lake, OH (US); Daniel L. Steele, Concord, OH (US); Diane L. Dodson, Sagamore Hills, OH (US)

(73) Assignee: The Scott Fetzer Company, Westlake, OH (US)

( * ) Notice: Subject to any disclaimer, the term of this patent is extended or adjusted under 35 U.S.C. 154(b) by 935 days.

(21) Appl. No.: 11/327,225

(22) Filed: Jan. 6, 2006

(65) Prior Publication Data

US 2007/0157418 A1 Jul. 12, 2007

(51) Int. Cl.
*A47L 5/32* (2006.01)

(52) U.S. Cl. ..... 15/329; 15/331; 15/338; 15/344

(58) Field of Classification Search ..... 15/323, 15/328, 329, 331, 334, 338, 344; *A47L 9/24, A47L 5/32*

See application file for complete search history.

(56) References Cited

U.S. PATENT DOCUMENTS 2,243,935 A * 6/1941 Williamson ..... 15/321
2,310,268 A * 2/1943 Taylor ..... 15/338
4,052,767 A 10/1977 Dutcher
4,357,729 A 11/1982 Vander Molen et al.
4,473,923 A 10/1984 Neroni et al.
4,611,365 A 9/1986 Komatsu et al.
4,660,246 A 4/1987 Duncan et al.
4,664,457 A 5/1987 Suchy
4,960,446 A 10/1990 Werner et al.
4,987,637 A 1/1991 Zummer et al.
5,303,447 A 4/1994 McKnight
5,495,636 A 3/1996 Dekker et al.
5,507,067 A 4/1996 Hoekstra et al.
5,542,147 A 8/1996 Merten
5,819,370 A 10/1998 Stein
5,836,047 A 11/1998 Lee et al.

(Continued)

FOREIGN PATENT DOCUMENTS

CA 2471407 12/2004

(Continued)

OTHER PUBLICATIONS

Extended European Search Report, issued Nov. 18, 2009, for European Application 07000197.9.

*Primary Examiner*—David A Redding
(74) *Attorney, Agent, or Firm*—Jones Day

(57) ABSTRACT

A vacuum cleaning apparatus includes a vacuum cleaner base and a handle configured to be attached to the base. A nozzle is configured for the base to draw air through the nozzle to clean the floor as the nozzle is moved along the floor by a user pushing the base by the handle. A power head assembly includes a power head having a brushroll and an electric motor that drives the brushroll. The assembly further includes a tube structure configured to connect the power head to the base for the base to draw air through the power head and the tube structure to clean the floor as the power head is moved along the floor by a user pushing the tube structure.

10 Claims, 7 Drawing Sheets

U.S. PATENT DOCUMENTS

| | | | |
|---|---|---|---|
| 5,842,254 | A | 12/1998 | Lee |
| 5,867,864 | A | 2/1999 | Miller et al. |
| 6,058,559 | A | 5/2000 | Yoshimi et al. |
| 6,122,796 | A | 9/2000 | Downham et al. |
| 6,134,746 | A | 10/2000 | Miller et al. |
| 6,295,692 | B1 | 10/2001 | Shideler |
| 6,345,408 | B1 | 2/2002 | Nagai et al. |
| 6,490,752 | B2 | 12/2002 | Kushida et al. |
| 6,497,001 | B2 | 12/2002 | Di Nunzio et al. |
| 6,546,593 | B2 | 4/2003 | Oh et al. |
| 6,664,748 | B2 | 12/2003 | Kushida et al. |
| 2001/0034922 | A1 | 11/2001 | Ko |
| 2004/0255426 | A1 | 12/2004 | Davis et al. |
| 2004/0261217 | A1 | 12/2004 | Shibuya et al. |

FOREIGN PATENT DOCUMENTS

| | | |
|---|---|---|
| EP | 1360922 | 11/2003 |
| GB | 2 400 310 | 10/2004 |
| GB | 2409803 | 7/2005 |
| GB | 2416680 | 2/2006 |
| RU | 2199261 | 2/2003 |

* cited by examiner

UPRIGHT VACUUM CLEANER WITH REMOVABLE POWER HEAD

TECHNICAL FIELD

This application relates to vacuum cleaners.

BACKGROUND

A vacuum cleaner includes a base and a nozzle. The nozzle can be removably attached to the base for vacuuming a carpeted floor.

SUMMARY

A vacuum cleaning apparatus includes a vacuum cleaner base and a handle configured to be attached to the base. A nozzle is configured for the base to draw air through the nozzle to clean the floor as the nozzle is moved along the floor by a user pushing the base by the handle. A power head assembly includes a power head having a brushroll and an electric motor that drives the brushroll. The assembly further includes a tube structure configured to connect the power head to the base for the base to draw air through the power head and the tube structure to clean the floor as the power head is moved along the floor by a user pushing the tube structure.

Preferably, the handle is configured to be removably attached to the base. The tube structure has a flexible tube enabling the power head to be manually moved independent of the base. The base is configured to sense which one of the nozzle and the power head assembly is attached to the base and control an operating condition of the base based on which one is attached to the base. The nozzle includes a brushroll. The base has a drive pulley for driving the brushroll of the nozzle. The base is configured to rotate the drive pulley when the nozzle is attached to the base but not when the power head assembly is attached to the base.

DESCRIPTION

Overview

Figure 1:
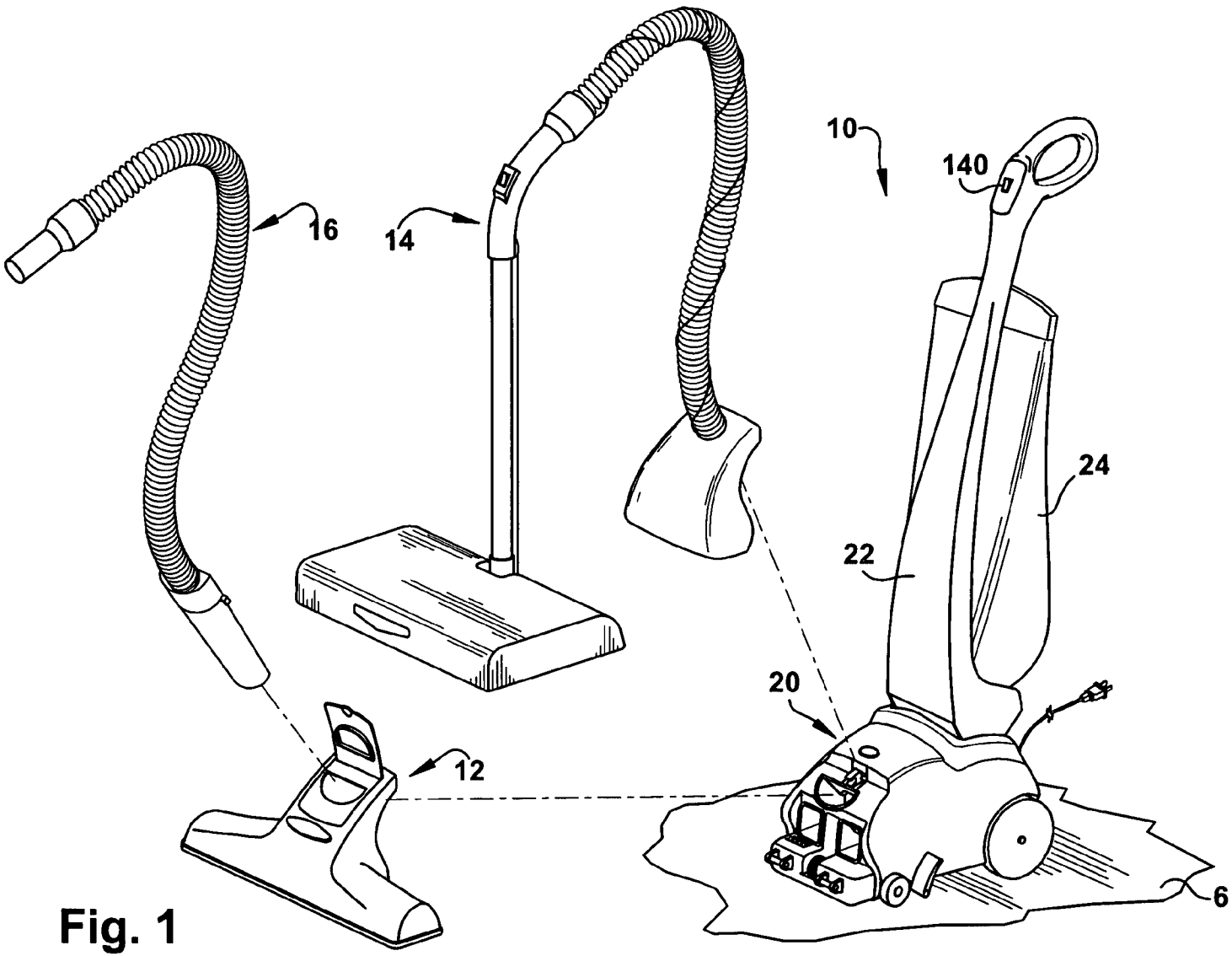
FIG. 1 is a perspective view of a base unit of a vacuum cleaner and various cleaning attachments that can be removably attached to it, including a nozzle, a power head assembly and an accessory hose.

The apparatus shown in FIG. 1 has parts that are examples of the elements recited in the claims. The apparatus thus includes examples of how a person of ordinary skill in the art can make and use the claimed invention. It is described here to meet the requirements of enablement and best mode without imposing limitations that are not recited in the claims.

The apparatus shown in FIG. 1 is used for cleaning household surfaces, such as a carpeted floor 6. The apparatus includes a base unit 10 and three cleaning attachments—a nozzle 12, a power head assembly 14 and an accessory hose 16. The nozzle 12 and the power head assembly 14 can be removably attached to the base unit 10 for vacuuming the floor 6. The hose 16 can be removably attached to the base unit 10 for vacuuming above-the-floor household surfaces. The base unit 10 with the three cleaning attachments 12, 14 and 16 can be sold as a set to a single buyer, who can use each attachment with the base as desired.

Base Unit

The base unit 10 comprises a base 20, a handle 22 pivotably connected to the base 20, and a filter bag 24 supported by the handle 22.

The handle 22 in this example is an "upright handle" by which a user, while standing, pushes the base 20 over the floor 6. The handle 22 is permanently attached to the base 20 in this example, but can instead be removably attached to the base 20.

Figure 2:
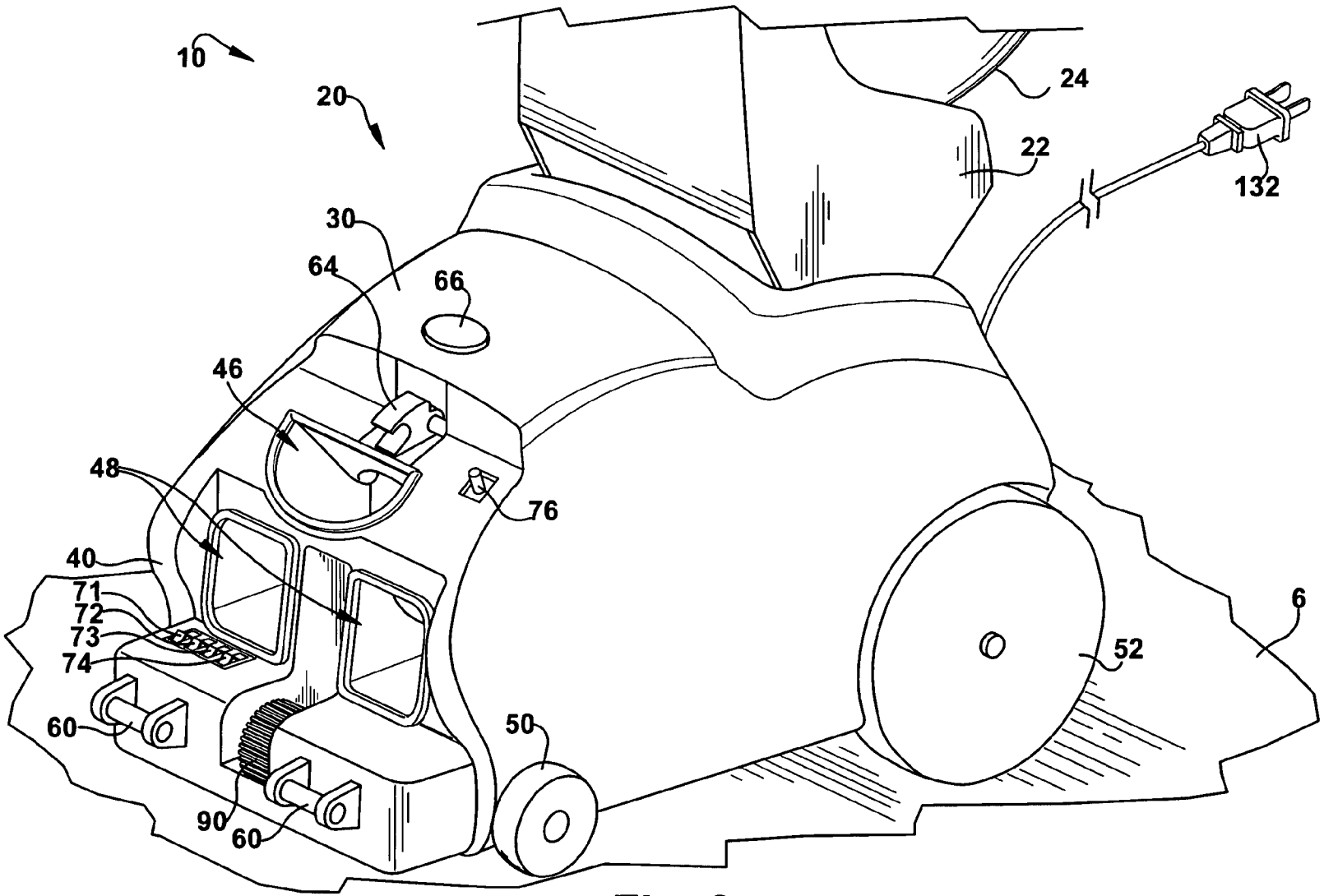
FIG. 2 is a perspective view of the base unit, showing its external parts.

As shown in FIG. 2, the base 20 has a housing 30. The housing 30 has a front face 40 with upper and lower inlet ports 46 and 48. Front wheels 50 and rear wheels 52 are rotatable connected to the housing 30 for wheeling the base 20 over the floor 6. The base 20 has two perch pins 60 and a bear claw latch 64 with a release button 66, for securing the cleaning attachments to the base 20. It also has four electrical contacts 71, 72, 73 and 74—respectively designated ground, 5VDC-out, 24VDC-out and resistance-sense. A front pushbutton switch 76 on the housing 30 senses whether the upper inlet port 46 is covered by a cleaning attachment.

Figure 3:
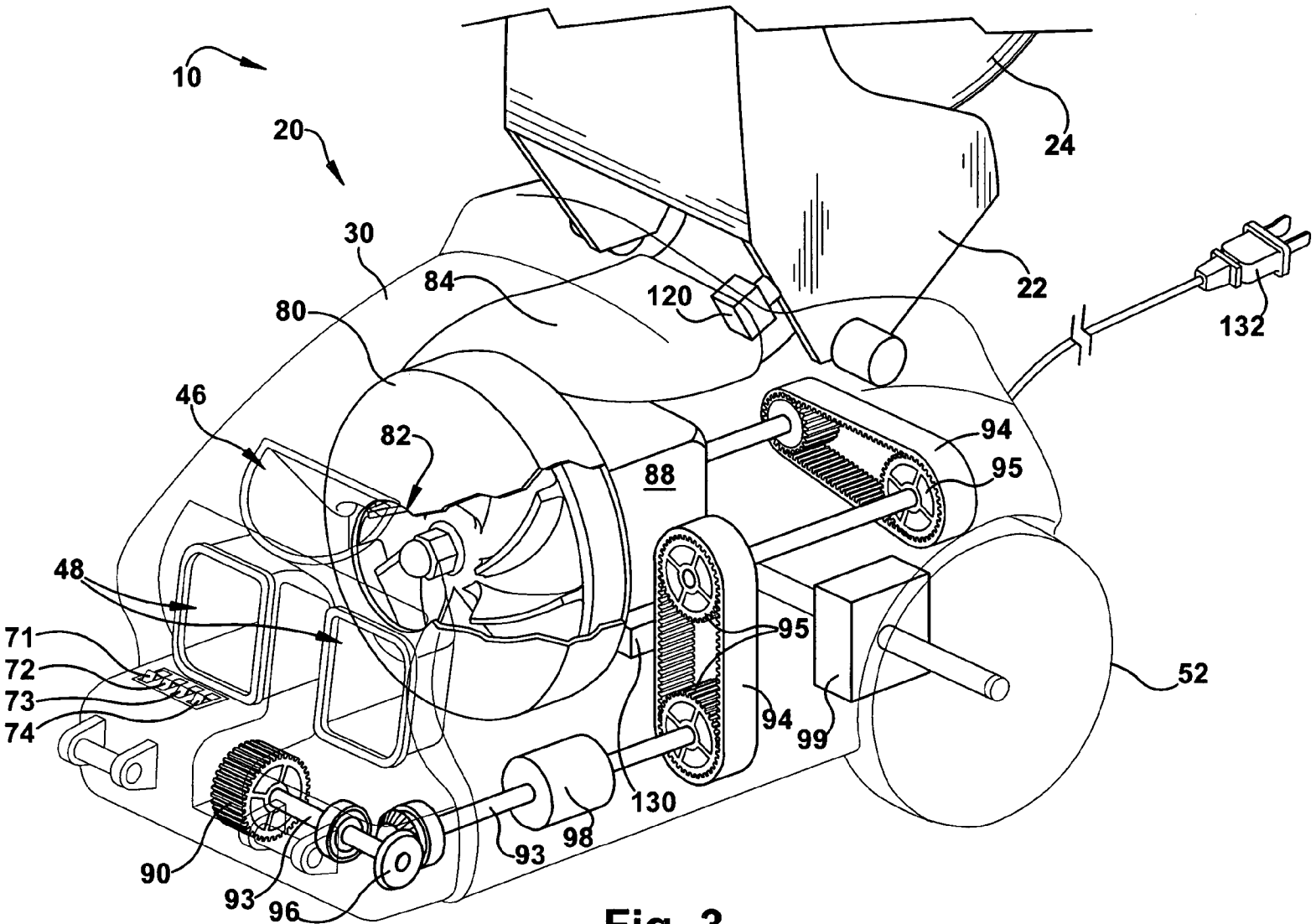
FIG. 3 is a perspective view of the base unit, showing its internal parts.

As shown in FIG. 3, a centrifugal fan 80 in the housing 30 has an inlet 82 connected to the inlet ports 46 and 48 and an outlet 84 connected to the filter bag 24. The fan 80 is driven by a motor 88. The motor 88 also drives a toothed drive pulley 90 through a drive train that includes shafts 93, belts 94, pulleys 95, a bevel gear 96 and an electrically actuated clutch 98. A drive assist motor 99 rotates the rear wheels 52 to propel the base 20. A rear pushbutton switch 120 senses whether the handle 22 is in an upright or inclined position.

A controller circuit 130 is electrically connected to the electrical components 71-74, 76, 88, 98, 99, 120 and 124 (FIGS. 2 and 3) of the base 20 to monitor and control operation of the base 20.

The circuit 130 receives wall current through a power cord 132. It generates a 5VDC and 24VDC supply that is output through the 5VDC-out and 24VDC-out contacts 72 and 73. It senses electrical resistance applied across the sense contact 74 and ground contact 71 by whichever attachment is installed on the base 20. Since each attachment applies a unique resistance, the controller 130 can determine which attachment, if any, is installed.

The controller 130 powers the motor 88 only when a power switch 140 (FIG. 1) on the handle 22 is switched on and the front switch 76 is depressed. The controller 130 engages the clutch 98 to couple the motor 88 to the drive pulley 90 only while the nozzle 12 is installed, and not when the power head 14 is installed. When the handle 22 is inclined, the controller 130 powers the drive assist motor 99 to rotate the rear wheels 52 in a direction and at a speed that correspond respectively to the direction and magnitude of the force manually applied to the handle 22, to assist the user in moving the base 20 over the floor 6.

Nozzle

Figure 4:
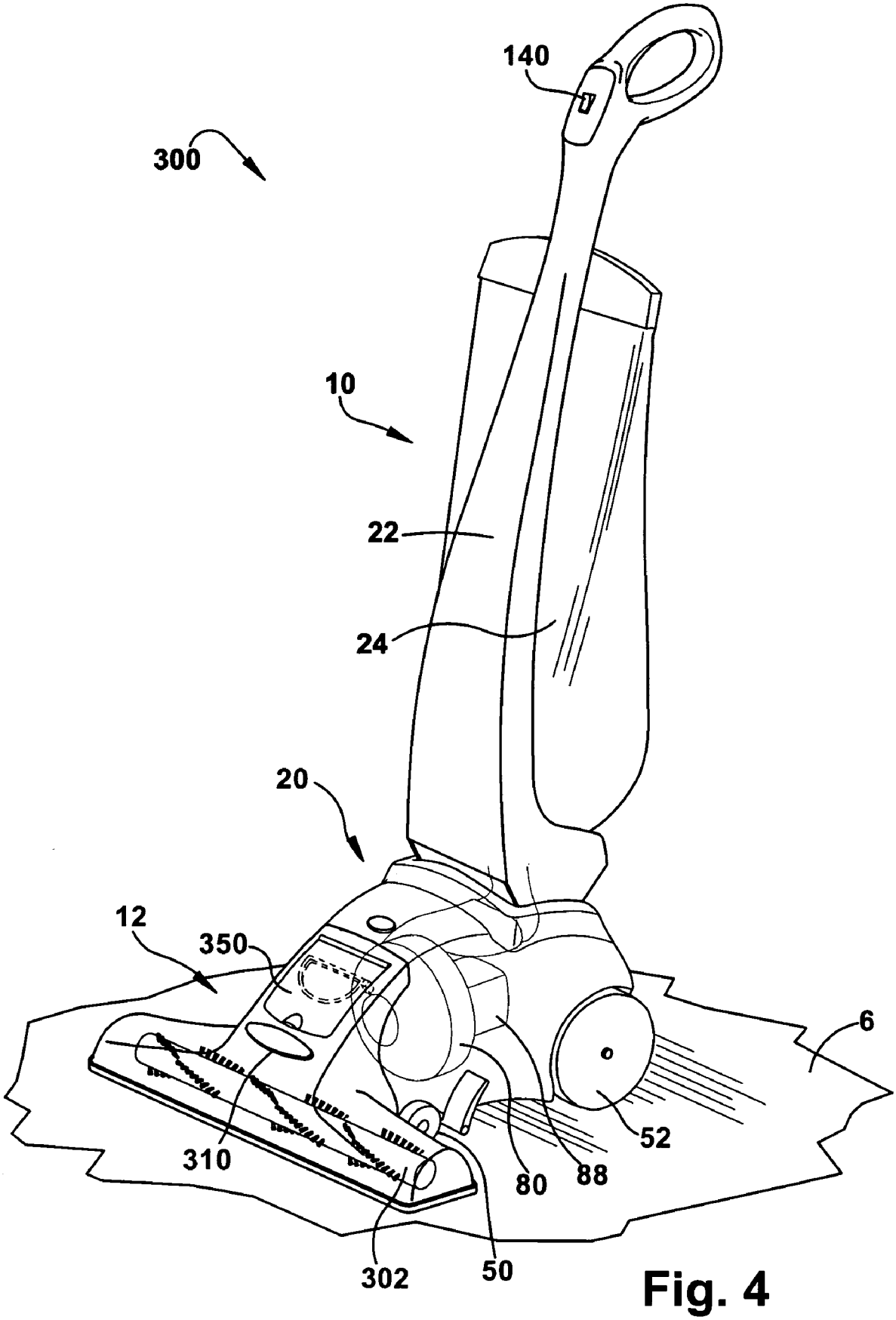
FIG. 4 is a perspective view of the base unit attached to the nozzle.

FIG. 4 shows an upright vacuum cleaner 300 comprising the nozzle 12 attached to the base unit 10. This type of cleaner is configured for the user to manually push the cleaner 300 by its handle 22 over the floor 6 to clean the floor 6. The nozzle 12 is supported by the base 20 to move with the base 20 as the base 20 is pushed by its handle 22.

The nozzle 12 has a brushroll 302 driven by the drive pulley 90 (FIG. 2) to rotate against the floor 6 to dislodge dirt from the floor 6. The fan 80 generates an air flow that carries the dirt from the floor 6, through the nozzle 12, the lower inlet ports 48 (FIG. 2) and the fan 80, into the filter bag 24. The nozzle 12 has a door 350 that covers and blocks the base's upper inlet port 46. A headlight 310 on the nozzle 12 illuminates the floor 6 in front of the cleaner 300. The headlight 310 is powered by electricity supplied by the base 20 through the base's ground and 5VDC-out contacts 71 and 72 (FIG. 2).

Accessory Hose

Figure 5:
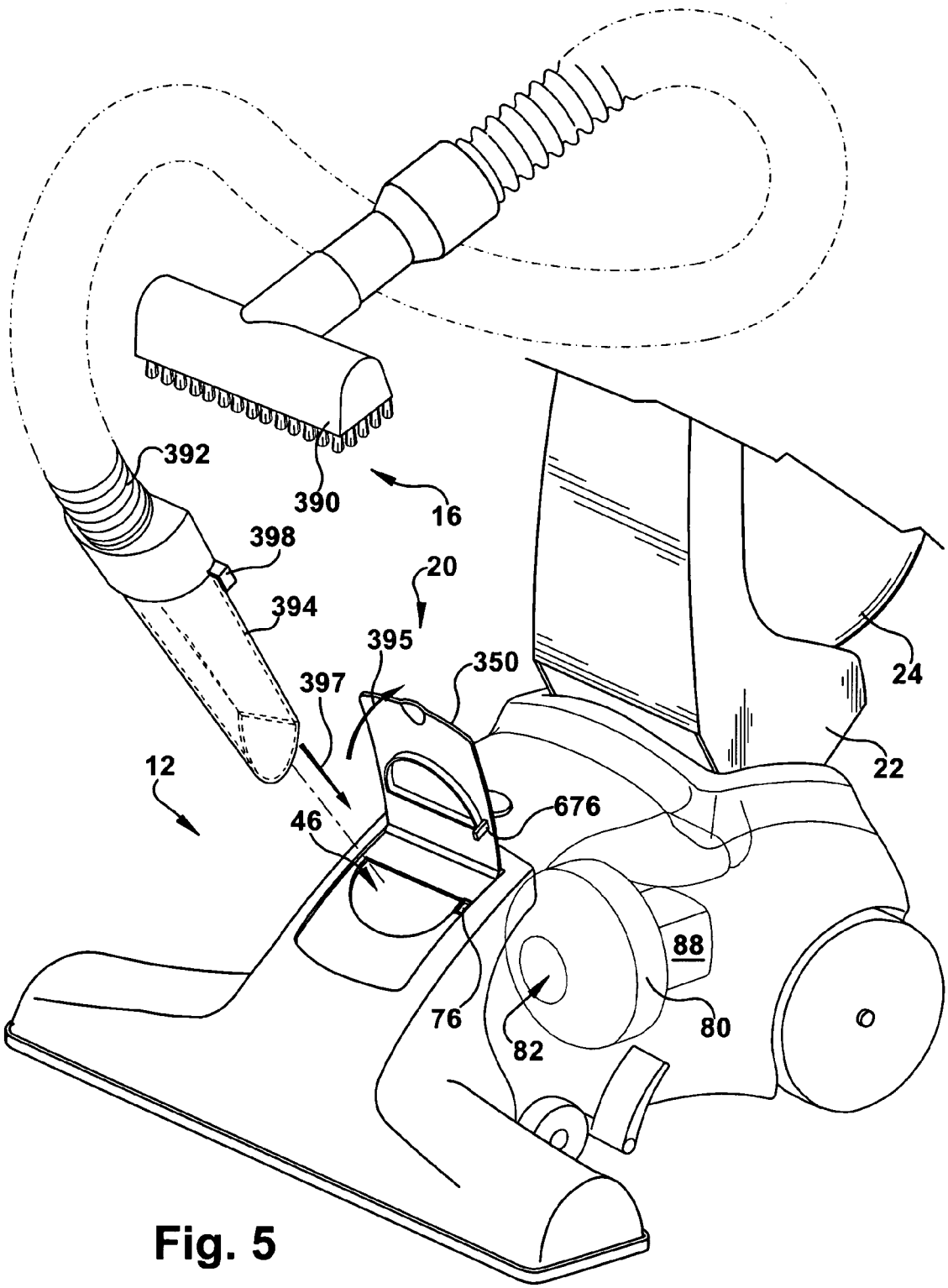
FIG. 5 is a perspective view illustrating a procedure for attaching the hose to the base unit.

As shown in FIG. 5, the hose 16 is configured to connect a hose accessory, such as a brush attachment 390, to the base 20. The hose 16 includes a flexible tube 392 and a rigid connector 394.

The hose 16 can be installed on the base 20 without removing the nozzle 12. This is done by opening the door 350 (arrow 395) and inserting the hose connector 394 into the upper inlet port 46 (arrow 397). A prong 398 projecting from the connector 394 engages the base's front switch 76. Within the base 20, the connector 394 conducts air from the hose 16 into the fan inlet 82 while isolating the nozzle 12 from the fan inlet 12.

The hose 16 can also be installed on the base 20, by simply inserting the hose connector 394 into the upper inlet port 46, without the nozzle 12 present. In this configuration, the controller 130 determines, by the lack of an applied resistance across the base's ground and sense contacts 71 and 74, that a cleaning head is not installed. The controller 130 then disengages the clutch 98 (FIG. 3) to uncouple the drive pulley 90 from the motor 88.

Power Head Assembly

Figure 6:
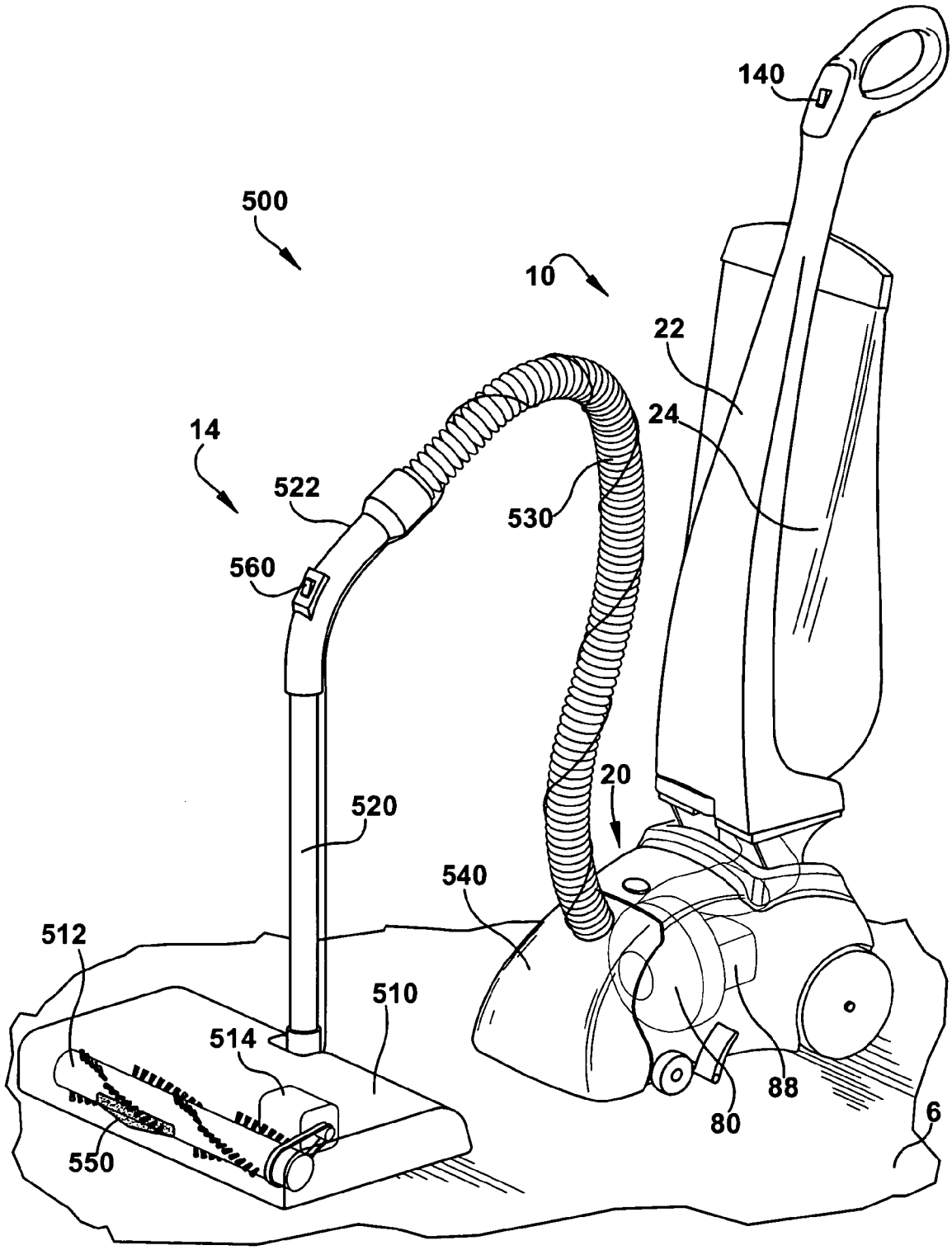
FIG. 6 is a perspective view of the base unit attached to the power head assembly.

FIG. 6 shows a canister type vacuum cleaner 500 comprising the power head assembly 14 attached to the base 20. This type of cleaner is configured for the base 20 to be pulled over the floor 6 by the assembly 14 as the user pushes the assembly 14 over the floor 6 to clean the floor 6.

The power head assembly 14 includes a power head 510 with a brushroll 512 driven by a motor 514. A rigid tube 520, with a handgrip 522, is pivotably connected to the power head 510. The rigid tube 520 is connected by a flexible tube 530 to a connector 540 that is removably attachable to the base 20.

A headlamp 550 on the power head 510 illuminates the floor 6 in front of the power head 510. The headlamp 550 and the motor 514 are respectively powered by 5VDC and 24VDC from the electrical contacts 71-73 (FIG. 2) of the base 20, through a power switch 560 in the handgrip 522.

In operation, a user grasps the handgrip 522 to both push the power head 510 over the floor 6 and pull the base 20 by the flexible tube 530. The flexible tube 530 enables the power head to be moved independently of the base 20 within an area limited by the length of the flexible tube 530. The brushroll 512 rotates against the floor 6 to dislodge dirt. The fan 80 generates an air flow that carries the dirt from the floor 6, through the power head assembly 14, the upper inlet port 46 (FIG. 2) and the fan 80, into the filter bag 24.

Figure 7:
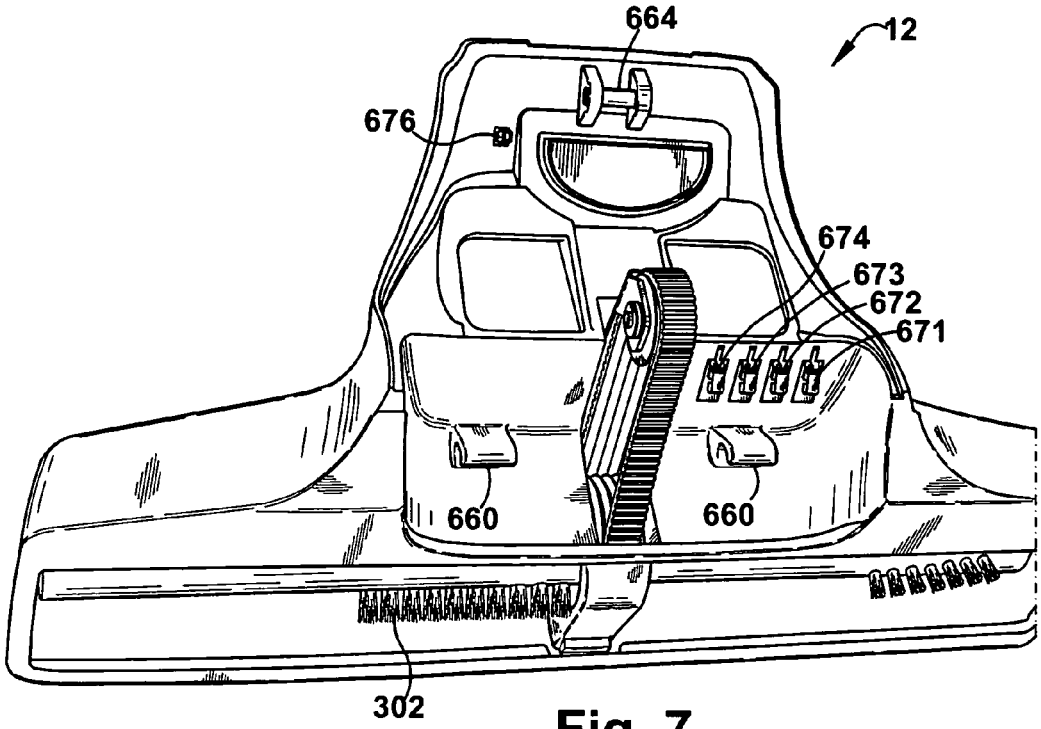
FIG. 7 is a rear perspective view of the nozzle.
Figure 8:
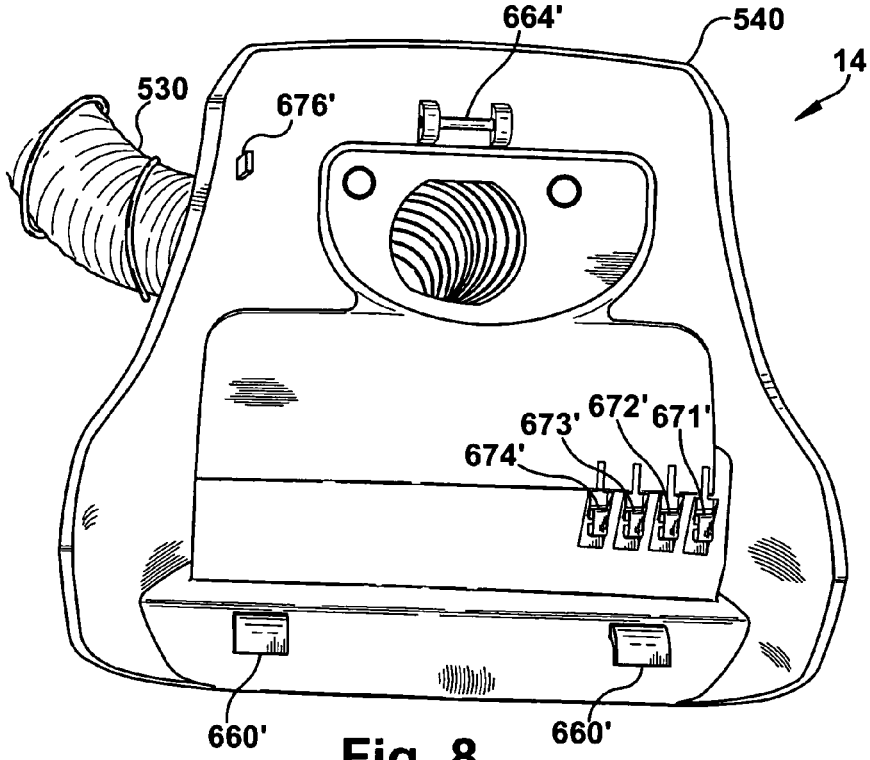
FIG. 8 is a rear perspective view of a part of the power head assembly.

The nozzle 12 (FIG. 4) and the power head connector 540 are both specifically designed by the manufacturer to be attachable to the particular base 20 shown in FIG. 2. Accordingly, the nozzle 12 and the connector 540 have similar structures that are uniquely sized, shaped and positioned for interconnection with the base 20. These structures include, as apparent by comparing FIG. 7 to FIG. 8 in view of FIG. 2, perch hooks 660 and 660' that hook onto the base's perch pins 60, a latch pin 664 and 664' grasped by the base's latch 64, electrical contacts 671-674 and 671'-674' that electrically contact the base's contacts 71-74, and a prong 676 and 676' that presses the base's front switch 76.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent structural elements with insubstantial differences from the literal language of the claims.

The invention claimed is:

1. A vacuum cleaning apparatus comprising:

a vacuum cleaner base;

a handle configured to be attached to the base;

a nozzle configured to be rigidly and removably attached to the base by a user of the apparatus, for the user to move the nozzle along a floor by pushing the base by the handle as the base draws air through the nozzle to clean the floor; and a power head assembly including a power head having a brushroll and an electric motor that drives the brushroll, and further including a tube structure through which the power head is configured to be attached to the base, for the base to draw air through the power head and the tube structure to clean the floor as the power head is moved along the floor by the user pushing the tube structure;

the nozzle and the tube structure configured to be interchangeably attached by the user to a front end of the base and blocked from being mounted on the base at the same time.

2. The apparatus of claim 1 wherein the handle is an upright handle.

3. The apparatus of claim 1 wherein the handle is configured to be removably attached to the base.

4. The apparatus of claim 1 wherein the tube structure includes a flexible tube enabling the power head to be manually moved independently of the base.

5. The apparatus of claim 1 wherein the motor of the power head is powered by electricity supplied by the base.

6. The apparatus of claim 1 wherein the base is configured to sense which one of the nozzle and the power bead assembly is attached to the base and control an operating condition of the base based on which one is attached to the base.

7. The apparatus of claim 1 wherein the nozzle includes a brushroll.

8. The apparatus of claim 7 wherein the base has a drive pulley for driving the nozzle's brushroll, and the base is configured to rotate the drive pulley when the nozzle is attached to the base but not when the power head assembly is attached to the base.

9. The apparatus of claim 1 wherein the base has a perch pin and a latch, by which both the nozzle and the power head assembly are each configured to be interchangeably attached to the base.

10. A method for use with the apparatus of claim 1, comprising:

designing the nozzle to be attached specifically to the base;

designing the power head assembly to be attached specifically to the same base; and manufacturing the base, the nozzle and the power head assembly.

* * * * *